US005261258A

United States Patent [19]

Bunger

[11] Patent Number: 5,261,258

[45] Date of Patent: Nov. 16, 1993

[54] PADLOCK PROTECTOR

[76] Inventor: Richard E. Bunger, 13625 S. 33rd St., Phoenix, Ariz. 85044

[21] Appl. No.: 955,698

[22] Filed: Oct. 2, 1992

[51] Int. Cl.[5] ..... E05B 67/38

[52] U.S. Cl. ..... 70/56; 70/417; 292/148; 292/346

[58] Field of Search ..... 70/54–56, 70/417, 129; 292/148, 346, DIG. 56, DIG. 57, DIG. 73

[56] References Cited

U.S. PATENT DOCUMENTS

| | | | |
|---|---|---|---|
| Re. 15,937 | 10/1924 | Fritts | 292/148 |
| 185,043 | 12/1876 | Osborn | 292/153 |
| 229,332 | 6/1880 | Pease | 70/40 |
| 500,254 | 6/1893 | Mayo | 292/153 X |
| 685,188 | 10/1901 | Taylor | 292/346 X |
| 1,017,315 | 12/1912 | Shone | 292/148 X |
| 1,428,367 | 9/1922 | Forlander | 292/346 |
| 1,599,459 | 9/1926 | Colombi et al. | 70/417 |
| 2,974,987 | 3/1961 | O'Brien | 292/148 |
| 3,334,933 | 8/1967 | Ehlers | 292/148 |
| 3,652,114 | 3/1972 | Cady et al. | 292/281 |
| 3,727,438 | 4/1973 | Knaack | 70/63 |
| 3,731,506 | 5/1973 | Greene et al. | 292/346 X |
| 3,736,016 | 5/1973 | Garvey et al. | 292/281 |
| 3,744,280 | 7/1973 | Brown, Jr. et al. | 70/54 |
| 3,850,014 | 11/1974 | Flack | 70/417 X |
| 3,884,057 | 5/1975 | Maurer | 70/259 |
| 4,095,828 | 6/1978 | East | 292/148 |
| 4,102,161 | 7/1978 | Proefrock | 70/42 |
| 4,277,961 | 7/1981 | Williams | 70/54 |
| 4,322,102 | 3/1982 | Lindblom | 292/281 |
| 4,452,371 | 6/1984 | Jurek | 70/129 X |
| 4,506,528 | 3/1985 | Eberly | 70/18 |
| 4,581,907 | 4/1986 | Eberly | 70/54 |
| 4,634,155 | 1/1987 | Geringer et al. | 292/144 |
| 4,655,487 | 4/1987 | Korn et al. | 70/56 X |
| 4,883,294 | 11/1989 | Goodspeed | 70/129 X |

FOREIGN PATENT DOCUMENTS

| | | | |
|---|---|---|---|
| 1135192 | 12/1968 | United Kingdom | 70/417 |

*Primary Examiner*—Lloyd A. Gall
*Attorney, Agent, or Firm*—Warren F. B. Lindsley

[57] ABSTRACT

A security device designed for protecting the shackle of a disk shaped padlock when mounted on a door of a container which consists of a housing for an armor protected latch bar which housing defines a recess providing access to an aperture in the bar by a circular shackle of the padlock. The recess also encases most of its housing exposing only the key tumbler of the lock which if tampered with will not cause movement of its concealed circular shackle. The latch bar is at least partially covered with a high carbon steel at the point it extends into an associated keeper.

9 Claims, 3 Drawing Sheets

FIG. 7
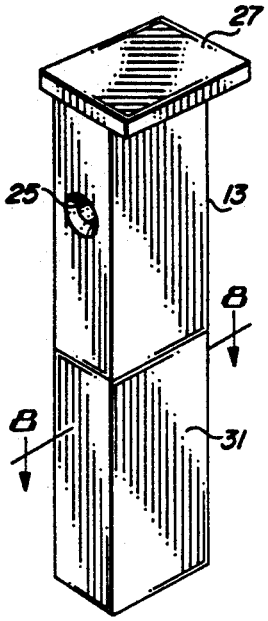
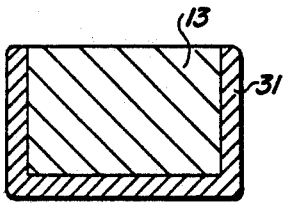
FIG. 8
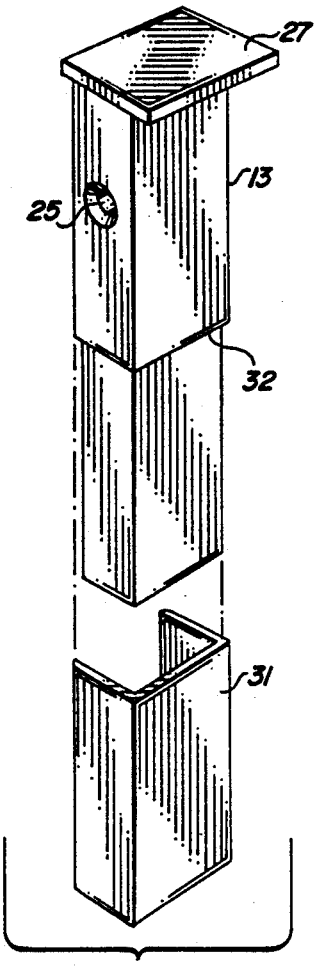
FIG. 10
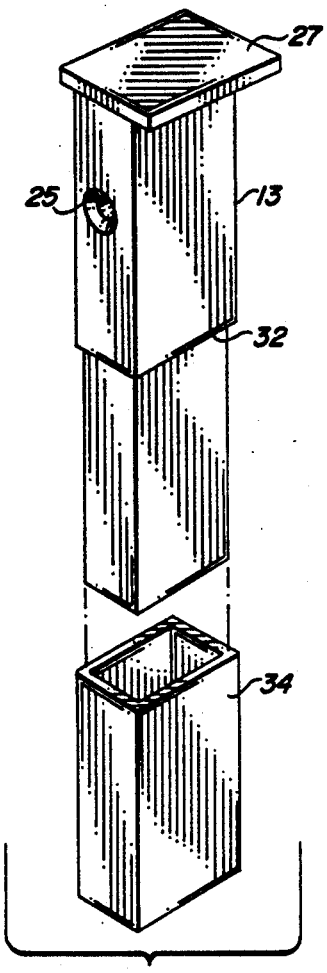
FIG. 11
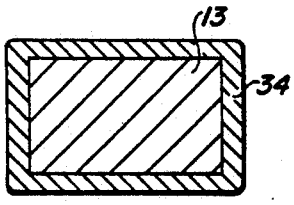
FIG. 9
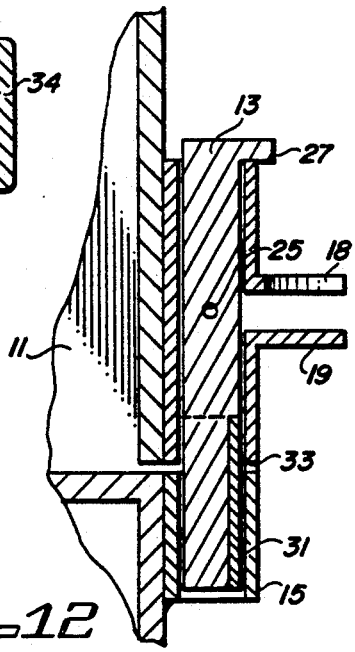
FIG. 12
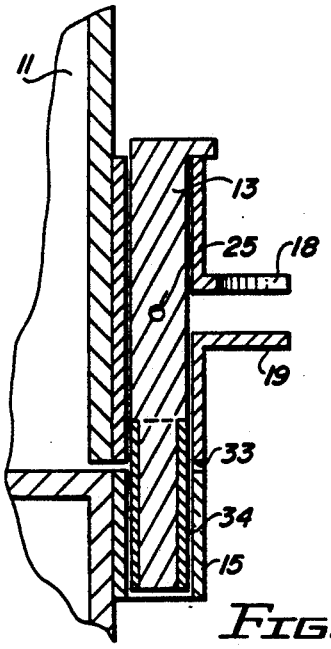
FIG. 13

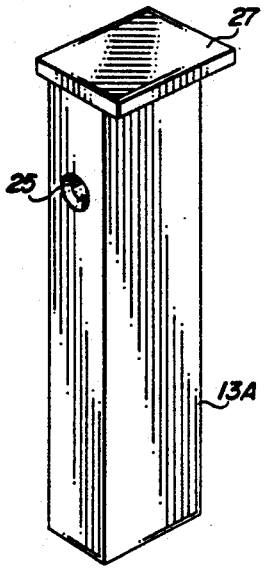
FIG. 14
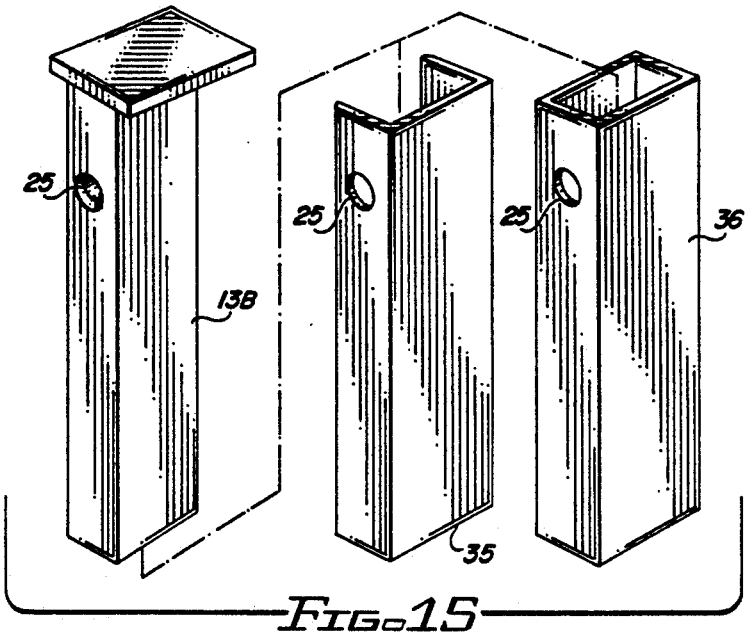
FIG. 15
FIG. 16
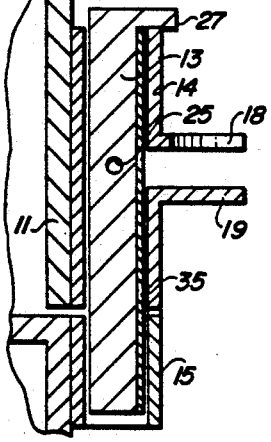
FIG. 17
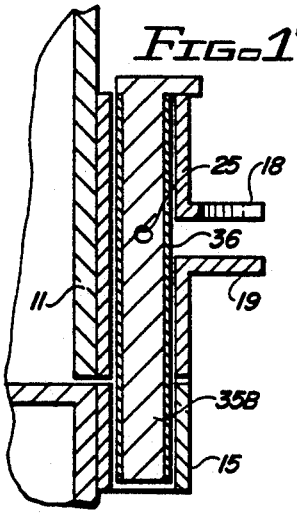
FIG. 19
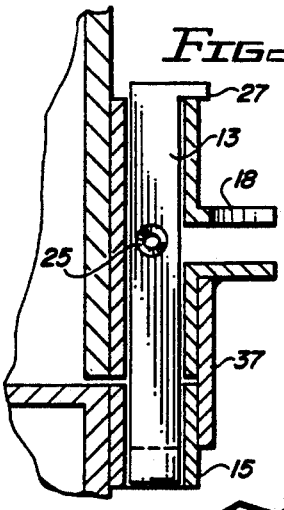
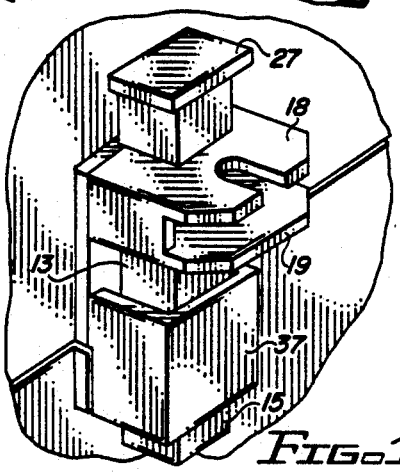
FIG. 18
FIG. 20
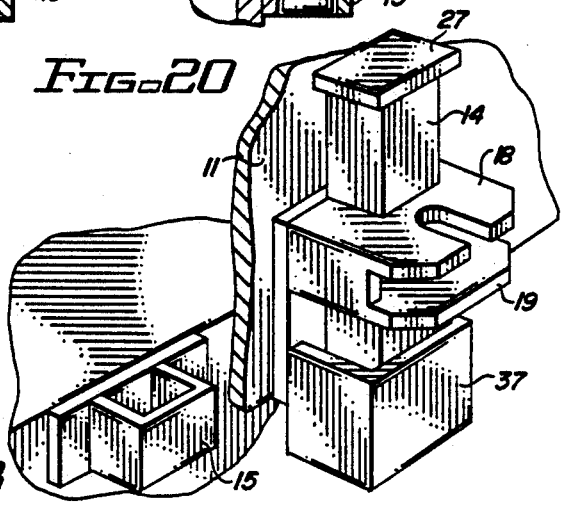

PADLOCK PROTECTOR

BACKGROUND OF THE INVENTION

This invention relates to a protective device for padlocks applied to interlocking parts at least one of which comprises a housing for enclosing a partially armor covered shiftable bar which housing is shaped to define a recess for receiving and covering the shackle of a padlock and most of its housing when the shackle interlocks with the shiftable bar.

The protective device is formed of steel to prevent access to the shackle of the padlock for severing purposes.

DESCRIPTION OF THE PRIOR ART

Although the prior art shows protective devices for padlocks, none are believed to illustrate the type of device disclosed and claimed for protecting the shackle of a padlock and the shiftable bar which are used to interlock relatively shiftable members of a locking system.

U. S. Pat. No. 3,744,280 discloses means for preventing the cutting or breaking of a padlock where access to the shackle is prevented by a guard, flange and case.

U S. Pat. No. 4,102,161 discloses a padlock having a pivotable sliding shackle.

U.S. Pat. No. 4,581,907 discloses a padlock protector in which the padlock shackle is inaccessible to a bolt cutter or other cutting device by wall portions which restrict access to the shackle.

The following U.S. patents of interest are directed to security lock protecting apparatus, but are not believed to anticipate the claimed invention.

4,506,528 3,736,016
4,322,102 3,727,438
4,277,961 3,652,114
3,884,057

SUMMARY OF THE INVENTION

In accordance with the invention claimed, an improved protective device for padlocks is provided which positions the circular shackle of a disk type padlock in an unaccessible position to a cutting or drilling tool and covers the shiftable bar with an armor like shield at the point of engagement with associated sleeve.

It is, therefore, one object of this invention to provide a new and improved protective device for padlocks employing partially armor covered shift levers or members to secure a door assembly in place to prevent theft.

Another object of this invention is to provide a padlock protector which includes retainer members defining a recess to receive the shackle of a padlock in a position to prevent the use of a cutting or drilling tool to sever the shackle.

A further object of this invention is to provide a padlock protector which permits a key tumbler of a disk type lock to be drilled out without causing or permitting the circular shackle to be rotated to open the lock.

Other objects and advantages of the invention will be set forth in the description which follows, and: in part will be obvious from the description of the hardware disclosed.

BRIEF DESCRIPTION OF THE DRAWINGS

The present invention may be more readily described by reference to the drawings in which:

FIG. 7 is a perspective view of the shiftable bar employing an armor lower portion;

FIG. 8 is a cross sectional view of FIG. 7 taken along the line 8—8;

FIG. 9 is a cross sectional view of a modification of the shiftable in FIGS. 7 and 8;

FIG. 10 an exploded view of the shiftable bar shown in FIG. 7;

FIG. 11 an exploded view of a modification of the shiftable bar shown in FIG. 10 employing the armor covering shown in FIG. 9;

FIG. 12 is a cross sectional view of the shiftable bar shown in FIGS. 8, 10 and 11 in locking engagement;

FIG. 13 is a cross sectional view of the shiftable bar shown in FIGS. 9, 11 and 12 in locking engagement;

FIG. 14 is a perspective view of a totally armor covered shiftable bar;

FIG. 15 is a perspective view of a shiftable bar which may be partially or totally covered with an armor covered shield;

FIG. 16 is a cross sectional view of the shiftable bar shown in FIG. 14 with the U-shaped armor covering of FIG. 15;

FIG. 17 is a cross sectional view of the shiftable bar shown in FIG. 14 with the closed rectangular armor covering shown in FIG. 15;

FIG. 18 is a perspective view showing a typical application of a padlock protector with a U-shaped armor sleeve welded in over the point of engagement of the shiftable bar cooperating sleeve;

FIG. 19 is a cross sectional view of FIG. 18 with the armor sleeve in place; and FIG. 20 is an exploded view of FIG. 18.

DESCRIPTION OF THE PREFERRED EMBODIMENT

Figure 1:
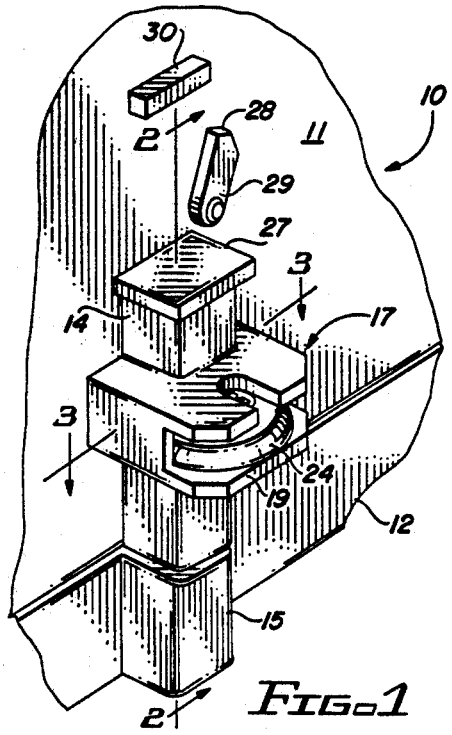
FIG. 1 is a perspective view showing a typical application of a padlock protector as applied to a door assembly of a cargo container door assembly in a locked position.

Referring more particularly to the drawings by characters of reference, FIGS. 1–6 disclose a protective device 10 used to lock at least one door 11 of a cargo storing container or other door assembly 12.

The free marginal part of door 11 carries a vertical hasp or bar 13 which moves longitudinally thereof to lock and unlock positions.

Bar 13 is mounted for movement longitudinally in a housing 14, mounted on door 11 which housing is axially aligned with a keeper or sleeve 15 mounted on the marginal part of storage device 12 juxtapositioned to the free marginal part of door 11 described above so that pin or bar 13 may be longitudinally moved into and out of the upper open end 16 of sleeve 15 to lock and unlock door 11.

Figure 3:
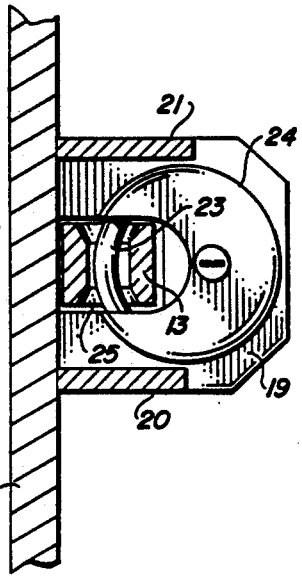
FIG. 3 is a cross sectional view of FIG. 1 taken along the line 3—3.
Figure 1A:
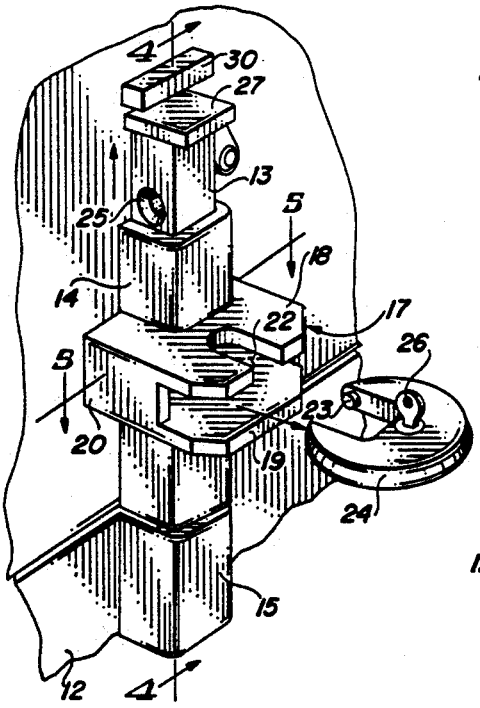
FIG. 1A is a perspective view similar to FIG. 1 showing the in an unlocked position.

Housing 14 comprises a padlock retainer 17 formed between its ends which retainer comprises a pair of spaced parallelly positioned plates or flanges 18 and 19 which, together with side plates 20 and 21 form an open cavity or recess 22 into which shackle 23 of a padlock 24 may be inserted as shown in FIGS. 1 and 3.

Figure 2:
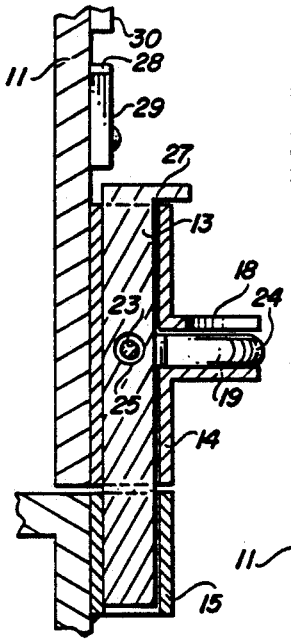
FIG. 2 is a cross sectional view of FIG. 1 taken along the line 2—2.

In order for shackle 23 of padlock 24 to engage and interlock with bar 13 of the protective device 10, a hole 25 is provided to extend laterally through bar 13 and is so positioned that shackle 23 can extend to and pass through it when bar 13 is in its lower position as shown in FIGS. 1 and 2.

Figure 4:
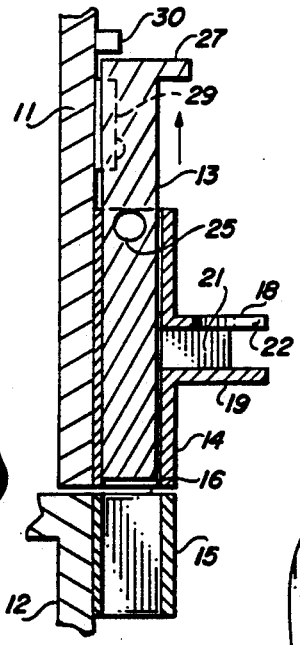
FIG. 4 is a cross sectional view of FIG. 1A taken along the line 4—4.
Figure 5:
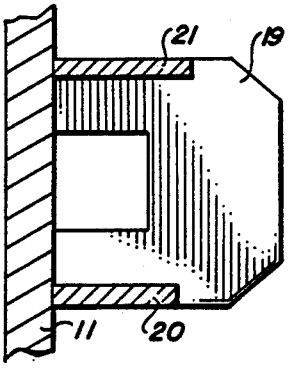
FIG. 5 is a cross sectional view of FIG. 1A taken along the line 5—5.

When the circular shackle is withdrawn from hole 25 in bar 13 by actuation of key 26 of the padlock, the bar may be actuated longitudinally of housing 17 to the position shown in FIG. 4 to unlock door 11.

Figure 6:
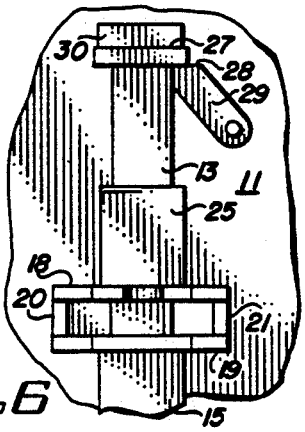
FIG. 6 is a view similar to FIG. 1 but showing the latch in unlocked position.

It should be noted that any suitable lift assembly or mechanism may be used to actuate bar 13 in housing 14 with bar 13 being limited in its downward movement by its flanged end 27 and its upward movement by stop 30 mounted on door 11. This flanged end 27 also serves as a collar under which the end 28 of a pivoted lever 29 may extend to hold the bar in its unlocked position as shown in FIG. 6.

When a locking procedure is undertaken, lever 29 is pivotally moved to its position shown in FIG. 1 so that bar 13 may be moved downwardly to move into sleeve 15 with hole 25 of bar 13 positioned for receiving therethrough the shackle of padlock 24. Since the shear point of pin or bar 13 is weakest at point of hole 25, the shear point is concealed within housing 14 when the disk lock is in place in the protector.

It should be noted that when padlock 24 is in position in retainer 17 of housing 14, its shackle 23 is within recess 22 of housing 17 out of reach and sight of a thief intending on cutting the shackle so that the padlock can be removed from the protective device. It should be noted that even though the key tumbler is drilled out the shackle of the lock cannot be rotated.

The only other point of weakness in the disclosed protective device is the space between the top of sleeve 15 and the bottom of housing 14 as shown in FIGS. 2 and 4. To overcome this point of weakness, bar 13 is provided with a high carbon steel collar 31 as shown in FIGS. 7, 8 and 10 which is fitted into a groove 32 formed in bar 13. This collar 31 may form a U-shaped configuration and extend ¾ around bar 13 at its lower end flush with the remainder of the surface of bar 13 as shown in FIGS. 7, 8 and 10. Thus, when bar 13 is in its extended position as shown in FIG. 12 only the high carbon steel covered surface of bar 13 is exposed between the lower ends of housing 14 in slot 33 and the top edge of sleeve 15.

A modification of collar 31 is shown in FIGS. 9 and 11 where cover 34 comprising a closed looped configuration which may, for example, form a square shaped configuration covering the perimeter of bar 13 in the same general manner as shown in FIGS. 7 and 10, i.e., its exposed surface is flush with the remaining exposed surface of bar 13.

As shown in FIGS. 12 and 13, collar 31 and 34 cover the exposure of bar 13 through slot 33. Therefore, anyone trying to break the locking mechanism by cutting bar 13 at this point runs into the high carbon steel forming collars 31 and 34 which is difficult to penetrate by the usual tools of a thief.

FIG. 14 is a perspective view of a shiftable bar 13A wherein the whole bar is formed of a high carbon steel material.

FIG. 15 discloses an exploded view of an armor covered shiftable bar 13A which is covered along its length either partially by a U-shaped armor sleeve 35 or totally along its length by a rectangular collar 36.

FIG. 16 is a cross sectional view of the shiftable bar 13B shown in FIG. 15 with the U-shaped sleeve 35 in locking position with the associated sleeve 15;

FIG. 17 is a cross sectional view of shiftable bar 13B shown in FIG. 15 with the closed rectangular collar 36 in locking position with the associated sleeve 15;

FIG. 18 is a perspective view of a further modification of the armor protected shiftable bar 13 wherein a U-shaped cover 37 is welded on the housing covering the point of engagement of the shiftable bar 13 with the associated sleeve 15;

FIG. 19 is a cross sectional view of FIG. 18 showing the protective armor sleeve 37 in place; and FIG. 20 is an exploded perspective view of the assembly shown in FIGS. 18 and 19.

Although but a few embodiments of the invention have been illustrated and described, it will be apparent to those skilled in the art that various changes and modifications may be made therein without departing from the spirit of the invention or from the scope of the appended claims.

What is claimed is:

1. A protective device for locking two relatively movable objects of a cargo container in a fixed relationship comprising:

a longitudinally movable bar mounted on one of said objects for cooperatively engaging with a keeper mounted on the other of said objects for locking said objects together, a housing mounted on said one of said objects for enclosing said bar, said housing comprising a padlock retainer formed between its ends for providing a recess which exposes a predetermined portion of the length of said bar when said bar is in cooperative engagement with said keeper and forms an opening for receiving the shackle of a padlock, said retainer comprising two parallelly spaced members forming said recess therebetween, an aperture formed in said predetermined portion to extend through said bar for receiving the shackle of the padlock when said bar engages said keeper.

said spaced members enclosing the shackle of the padlock when it extends through said aperture.

said bar being provided with an armor surface covering at least the portion of said bar extending between said housing and said keeper when engaging said keeper.

2. A protective device for locking two relatively movable objects of a cargo container in a fixed relationship comprising:

a longitudinally movable bar mounted on one of said objects for cooperatively engaging with a keeper mounted on the other of said objects for locking said objects together, a housing mounted on said one of said objects for enclosing said bar, said housing comprising a padlock retainer formed between its ends for providing a recess which exposes a predetermined portion of the length of said bar when said bar is in cooperative engagement with said keeper and forms an opening for receiving the shackle of a padlock, said retainer comprising two parallelly spaced members forming said recess therebetween, an aperture formed in said predetermined portion to extend through said bar for receiving the shackle of the padlock when said bar engages said keeper, said spaced members enclosing the shackle of the padlock when it extends through said aperture, said bar being provided with an armor surface covering at least the portion of said bar extending between said housing and said keeper when engaging said keeper, said bar comprising a flange at one end thereof for limiting the movement of said bar in interlocking engagement with said keeper, and a latch mounted on said one of said objects for engaging with said flange for holding said bar in a non-engaging position with said keeper.

3. The protective device set forth in claim 2 wherein: said bar totally formed of high carbon steel.

4. The protective device set forth in claim 2 wherein: said armor surface comprises a high carbon steel collar.

5. The protective device set forth in claim 2 wherein: said bar is provided with a groove extending at least partially around said bar at the end receiving said armor surface which places the exposed surface of said armor surface level with the exposed surface of the remainder of said bar.

6. The protective device set forth in claim 2 wherein: said armor surface comprises a U-shaped configuration.

7. The protective device set forth in claim 2 wherein: said members are spaced apart a distance slightly larger than the width of the padlock.

8. The protective device set forth in claim 2 in further combination with:

an armored collar secured to said housing for extending over associated ends of said housing and said keeper for shielding said movable bar when in keeper engaging position.

9. The protective device set forth in claim 8 wherein said armored collar is welded to said housing.

* * * * *

UNITED STATES PATENT AND TRADEMARK OFFICE

CERTIFICATE OF CORRECTION

PATENT NO. : 5,261,258

DATED : November 16, 1993

INVENTOR(S) : Richard E. Bunger

It is certified that error appears in the above-identified patent and that said Letters Patent is hereby corrected as shown below:

Column 4, line 51, cancel the period and substitute ---,---.

Column 4, line 53, cancel the period and substitute ---,---.

Signed and Sealed this

Nineteenth Day of April, 1994

Bruce Lehman

*Attest:*

BRUCE LEHMAN

*Attesting Officer*

*Commissioner of Patents and Trademarks*